United States Patent [19]

Adams et al.

[11] Patent Number: 4,621,828

[45] Date of Patent: Nov. 11, 1986

[54] SAFETY BINDING FOR NORDIC SKIIS

[76] Inventors: Edward E. Adams, P.O. Box 481, Mackay, Id. 83251; Robert L. Brown, 3016 Secor Ave., Bozeman, Mont. 59715

[21] Appl. No.: 655,039

[22] Filed: Sep. 27, 1984

[51] Int. Cl.[4] ..... A63L 9/086

[52] U.S. Cl. ..... 280/615; 280/618; 280/620; 280/631

[58] Field of Search ..... 280/614, 615, 617, 618, 280/616, 620, 631, 635, 624

[56] References Cited

U.S. PATENT DOCUMENTS

| | | | |
|---|---|---|---|
| 1,547,618 | 7/1975 | Seeberg | 280/615 |
| 3,905,613 | 9/1975 | Romeo | 280/613 |
| 3,934,893 | 1/1976 | Greenleaf | 280/615 |
| 4,002,354 | 1/1977 | Ramor | 280/614 |
| 4,348,036 | 9/1982 | Settembre | 280/615 |

*Primary Examiner*—John J. Love
*Assistant Examiner*—Richard Camby
*Attorney, Agent, or Firm*—Richard C. Conover

[57] ABSTRACT

An improved ski binding for use with a cross country ski and a boot having a forwardly projecting sole portion. The binding including a toe plate to be secured to the ski boot with a bail means and an elastic strap connected to the bail means. The elastic strap is adapted to fit around the heel of the boot and when so positioned causes the bail means to clamp the ski boot to the toe plate. A pair of open faced sockets are mounted to the ski. A toe piece is secured to the toe plate and has a pair of release buttons each received by a corresponding one of the open faced sockets. Further each of the release buttons has a spring means for resiliently urging each release button into a corresponding socket whereby the toe piece and thus the ski boot is releasably held by the sockets to the ski.

9 Claims, 9 Drawing Figures

SAFETY BINDING FOR NORDIC SKIIS

BACKGROUND OF INVENTION

This invention relates to a cross country ski binding and in particular to a cross country ski binding which enables a skier's boot to separate from the ski when the binding is subjected to forces which, if the boot did not release, may cause injury to the skier or damage to the boot.

There have been problems with conventional cross country ski bindings which use raised pins mounted to the ski for securing the ski boot to the ski. These problems have become more acute in recent years due to the fact that nordic skiers are using cross country skiis in a more strenuous manner than has been the case heretofore. For example, persons are using "telemark" ski techniques in skiing on downhill slopes and are using nordic skis in mountainous terrain on steep inclines.

There have been substantial developments in boot design to enable cross country skiers to ski under these conditions. Most commonly, the boots have been made of stronger materials and are made of sturdier construction. However, there remains problems with the ski bindings themselves because the raised pins tend to deteriorate female portions of the ski boot which receive the pins causing the ski boot to be held less securely to the ski. Very frequently, cracking and tearing of the boot sole where the female portions are located occurs after limited use of the boot. This requires either boot replacement or boot repair since this cracking or tearing quickly leads to complete failure of the sole. Furthermore,- there have been safety problems with these conventional nordic ski bindings because they do not release the boot from the ski under, for example, twisting conditions. This has resulted in injury to skier's legs, knees and ankles.

In recent years releasable ski bindings have been developed for use with nordic skiis. Releasable bindings are well known in the downhill ski industry but are not very well known and have seldom been used with nordic skiis. One releasable safety binding developed for nordic skiis is described in U.S. Pat. No. 4,348,036 to Settembre. This patent describes a safety binding for cross country skiis that is capable of releasing a ski boot when the binding is over stressed by forces acting in any direction. This patent describes a ski binding which has a toe piece mounted to the boot with screws. The toe piece is releasably clamped between the arms of a scissor mechanism mounted to the ski. Biasing means act between the arms of the scissor to urge the scissor members into a closed position thus releasably holding the boot of the skier to the ski.

SUMMARY OF INVENTION

The present invention is an improvement over the safety bindings used with nordic skiis which are now known in the art.

The present invention includes a toe piece which is secured to a partial boot plate which in turn is secured to the ski boot by an elastic strap or cable means. The toe piece includes a release tube which has incorporated therein two laterally extending release buttons. The two release buttons are resiliently biased outwardly with a spring mounted within the release tube. The biasing force of this spring is adjustable. The two release buttons are held by an opposed pair of upright sockets mounted on the ski itself. When the ski boot is subjected to forces which overcome the force holding the release buttons in their corresponding sockets the release buttons are forced out of the sockets thereby releasing the ski boot from the ski.

A feature of the present invention is that a skier may pivot on the ball of his foot or may pivot his entire foot away from the ski. A further feature of the present invention is the use of elastic straps or cables which hold the boot to the toe piece. When the cable is clamped to the boot, a bail is moved downwardly and clamps the projecting forward sole of the conventional nordic ski boot to the boot plate. This makes unnecessary the use of conventional raised pins for securing the ski boot to the ski. This feature also enables the use of any boot such as a hiking boot or climbing boot which has a forwardly projecting sole portion which can be gripped by the bail.

The present invention is very simple in construction and yet is durable. The present ski binding further provides a cross-country ski binding which permits a ski boot to be released from the ski when the boot is subjected to overstress.

BRIEF DESCRIPTION OF THE DRAWINGS

In order that the invention can be clearly understood and readily carried into effect a preferred embodiment will now be described, by way of example only, with reference to the accompanying drawings wherein.

DESCRIPTION OF A PREFERRED EMBODIMENT

Figure 1:
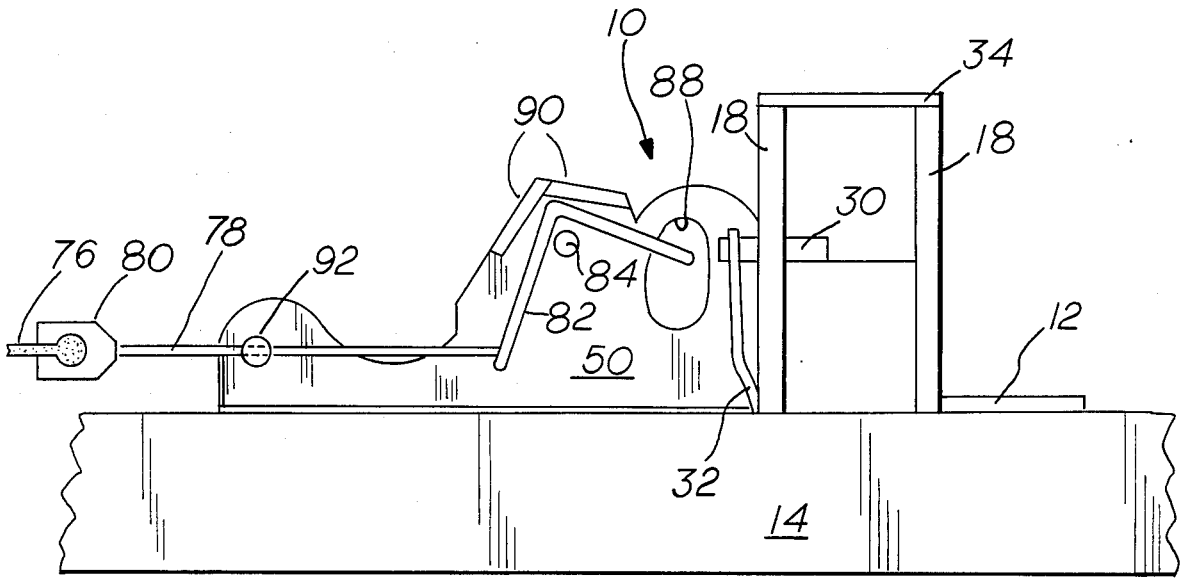
FIG. 1 is an elevational view of the safety binding, according to the present invention, mounted on a ski.
Figure 2:
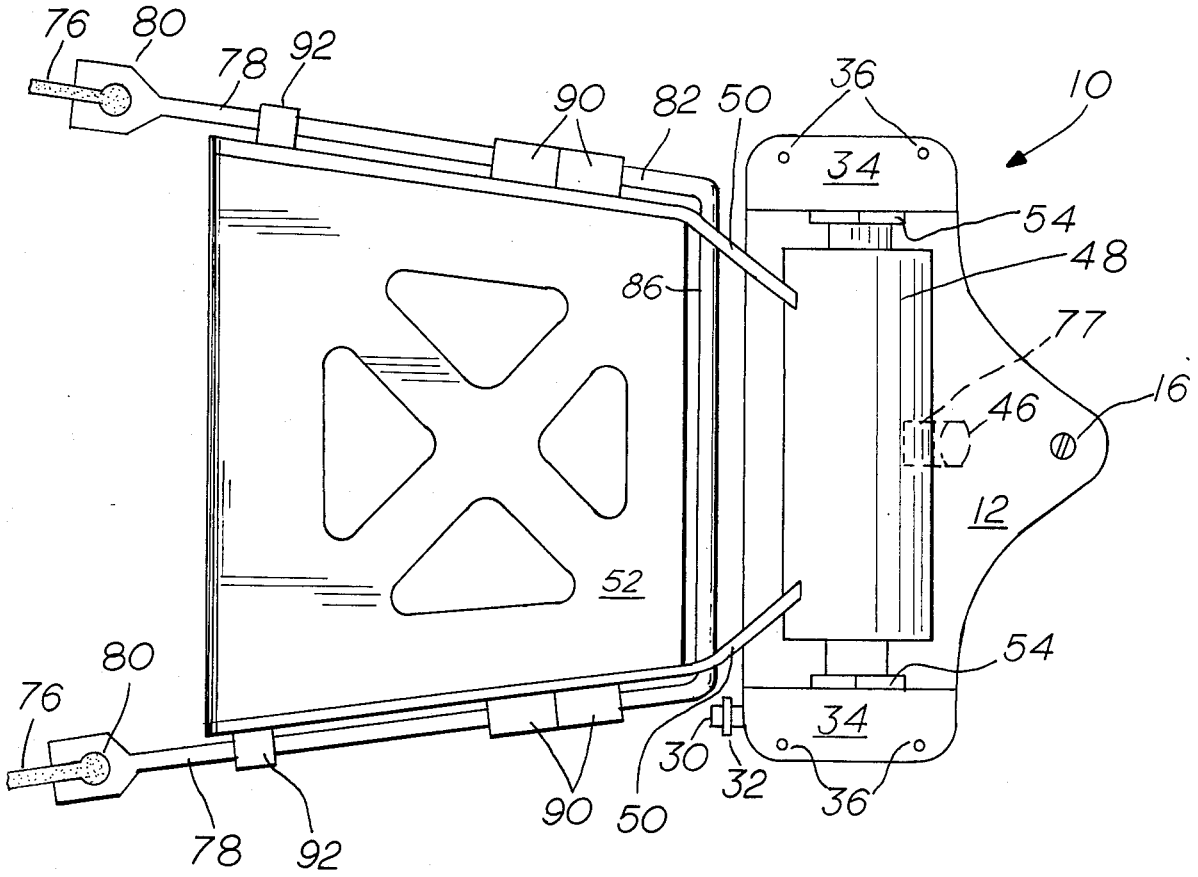
FIG. 2 is a top view of the ski binding shown in FIG. 1.
Figure 3:
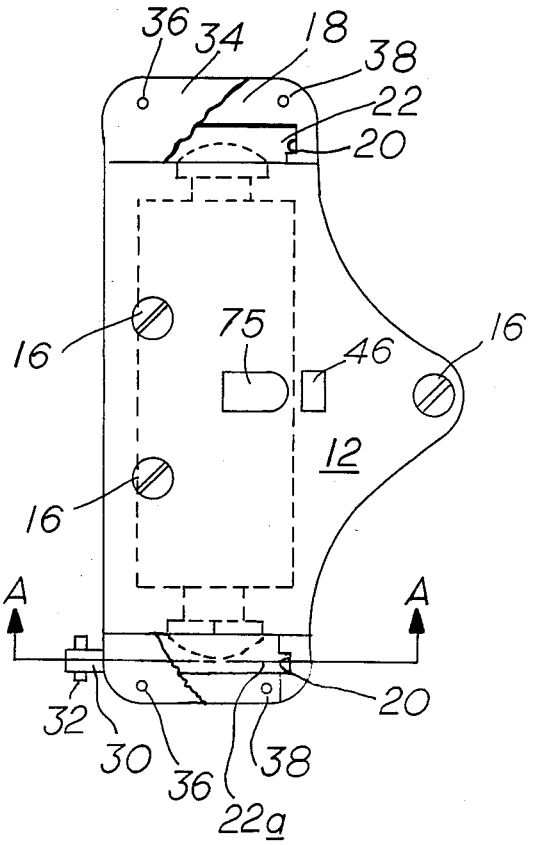
FIG. 3 is a top view of the mechanism with portions removed for releasably mounting the release tube to the ski with the release tube shown in phantom.
Figure 4:
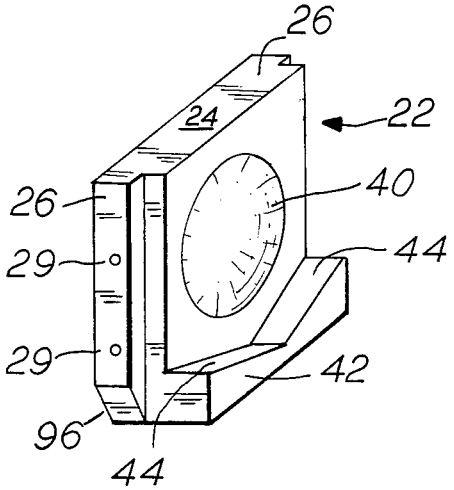
FIG. 4 is a perspective view of the inserts used with the mechanism as shown in FIG. 3.
Figure 5:
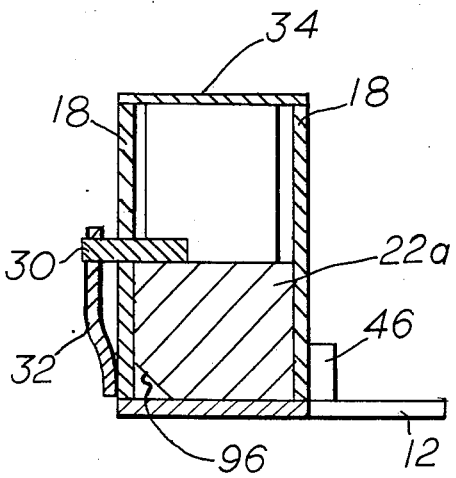
FIG. 5 is a cross-sectional view along line A—A in FIG. 3.

A safety binding 10 according to the present invention is shown in FIGS. 1 and 2. The binding includes a mounting member 12 which is secured to a ski 14 with screws 16 as shown in FIGS. 1 and 3. Mounting member 12 includes two uprising members 18 which are affixed to the mounting member 12 on opposite lateral sides thereof and facing one another. Each uprising member 18 has a slot 20 for receiving an insert 22 as shown in FIG. 3. A perspective view of the inserts 22 is shown in FIG. 4. This insert 22 has a body 24 which has a projecting portion 26 which slidably fits in slot 20 of the uprising members 18. The projecting portions 26 when inserted in slots 20 prevent the inserts 22 from moving in any direction in the horizontal plane. One of the inserts 22 (the top one shown in FIG. 3) is secured in slot 20 with pins 28 received by bores 29, shown in FIG. 4, located in insert 22 to prevent vertical movement of insert 22. There are bores 29 and associated pins on the opposite side of insert 22 hidden from sight in FIG. 4. The other insert 22 (the bottom one shown in FIG. 3) is not affixed in slot 20 but is permitted to move vertically in slot 20. This insert shall be hereinafter referred to as insert 22*a* for purposes of the following discussion. However inserts 22 and 22*a* are structurally the same and reference to structure of insert 22 shall also apply to insert 22*a*. This insert 22*a* is releasably secured in place by a plunger 30 which is resiliently biased with spring 32 secured to uprising member 18 as shown in FIGS. 1, 3 and 5. When the insert 22*a* is located in its lowermost position as shown in FIG. 5 the plunger 30 engages the top surface of body 24 of insert 22*a* as shown in FIG. 4 thus preventing the insert 22*a* from moving vertically. When it is desired to move the insert 22*a* upwardly, as will be subsequently described, plunger 30 is moved against the force of spring 32 to permit the insert 22*a* to be moved upwardly.

Figure 6:
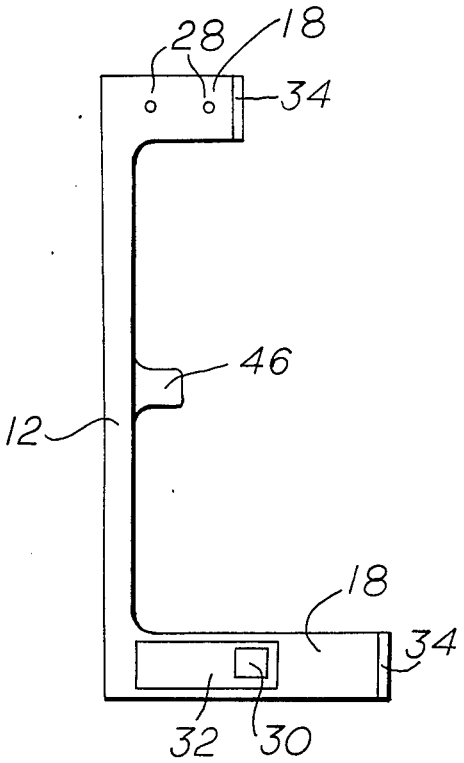
FIG. 6 is a left side view of the mechanism shown in FIG. 3.

Caps 34 are secured to uprising members 18 as shown in FIGS. 2 and 6 with screws 36 to prevent inserts 22 and 22*a* from being displaced from uprising members 18. The screws 36 are received by bores 38 in uprising member 18 as shown in FIG. 3 which has the caps 34 partially broken away.

An inner surface of the inserts 22 has a concave hemispherical socket 40 as shown in FIG. 4. The lower portion of body 24 has an inwardly projecting portion 42 as shown in FIG. 4. This inwardly projecting portion 42 has two ramps 44 which extend downwardly toward the median of the lower wall of insert 22 as shown in FIG. 4.

The mounting member 12 further includes an upwardly rising post 46 shown in FIGS. 3 and 6. This post serves to provide a pivot point for enhancing release of the binding upon twisting of the boot with respect to the ski as will be subsequently described. Furthermore this post 46 acts to prevent the binding from releasing when forces acting on the ski boot tend to cause the boot to move forwardly with respect to the ski. This is done to prevent release of the boot under these conditions, because forward forces are non-harmful and normally occur when the ski boot is being stressed under normal skiing conditions.

The binding 10 includes the mounting member 12 which is mounted to the ski and also includes a toe piece which is releasably mounted in the sockets 40 mounted in the upright support members 18. This toe piece will now be described with reference to FIGS. 1, 2 and 7. This toe piece includes a tubular housing 48. The tubular housing 48 is fixedly mounted to upstanding and opposed side members 50 which are integrally formed with toe plate 52 as shown in FIGS. 1 and 2. The tubular housing 48 is mounted to the side members 50 as by welding or rivots.

Figure 7:
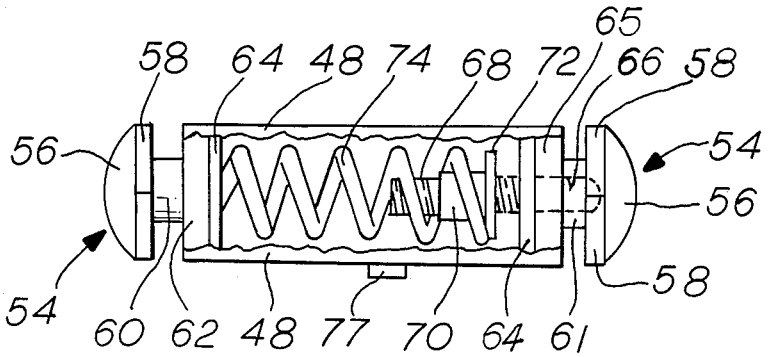
FIG. 7 is a view of the release tube and release buttons according to the present invention with portions of the outer cover tube broken away.

Tubular housing 48 supports two axially moveable release buttons 54 as shown in FIG. 2 and FIG. 7. These release buttons are positioned in line on a line perpendicular to the longitudinal axis of the ski as shown in FIG. 2. The release buttons 54 include a hemispherical outer portion 56 which is intregrally formed with a hexagonal portion 58. A shaft 60 is integrally formed with the left hand release button 54 as shown in FIG. 7. The shaft 60 is supported in the tubular housing 48 by a bushing 62 which has a central bore sized to slidably receive the shaft 60. The bushing is held in the tubular housing 48 by a snap ring (not shown). A stop piece 64 is secured adjacent to the end of the shaft 60 opposite the release button 54.

The right hand release button 54 as shown in FIG. 7 is secured to a shaft 61. This shaft 61 includes an interior threaded bore 66. This interior bore 66 receives a threaded shaft 68. The shaft 68 is inserted through a corresponding bore in a stop piece 64 which is integrally secured to the left hand end of shaft 61 as shown in FIG. 7 and extends into the threaded bore 66. Mounted on the threaded shaft 68 is a spring cap nut 70 which has a head portion 72. The shaft 61 is supported in the tubular housing 48 by a bushing 65 which has a central bore used to receive the shaft 61. This bushing is also held in the tubular housing by a snap ring (not shown). The threaded shaft 68 is restrained from rotating relative to the shaft 61 by a locking pin (not shown).

A coil spring 74 is slidably positioned within tubular housing 48 around the threaded shaft 68 as shown in FIG. 7. An end of the coil spring 74 is received by a cap nut 70 as shown in FIG. 7 and the other end is positioned in abutting relation with stop piece 64.

As is readily apparent from FIGS. 2 and 7, the compressive force of the coil spring 74 acting on release buttons 54 can be adjusted by rotating the right-hand release button 54 as shown in FIG. 7.

The hemispherical portion 56 of the release button 54 is sized to fit within the hemispherical socket 40 of insert 22. The ramps 44 of insert 22 are shaped to engage two sides of the hexagonal portion 58 of the release buttons 54 when the release buttons 54 are moved downwardly against ramps 44. In this manner, the release buttons cannot rotate once set and in use, thus insuring that the spring setting does not change when the binding is being used.

Figure 8:
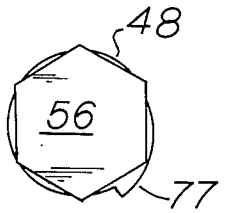
FIG. 8 is a left side full view of the cross-sectional view shown in FIG. 7 showing an end view of the release button.

The mounting member 12 has a cut-out portion 75 as shown in FIG. 3 which receives a stop member 77 affixed to tubular housing 48 as shown in FIGS. 2, 7 and 8, when the tubular housing 48 rotates about its longitudinal axis in a clockwise direction as shown in FIG. 8. The stop member 77 is sized and mounted to tubular housing 48 in such a manner as to prevent the tubular housing 48 from rotating more than about 35° from its normal position as when a user pivots his ski boot upwardly from the ski. The stop member 77 engages the back (i.e. left side) face of the cut-out 75 as shown in FIG. 3 and thus prevents further rotation of tubular housing 48 and toe plate 52.

Figure 9:
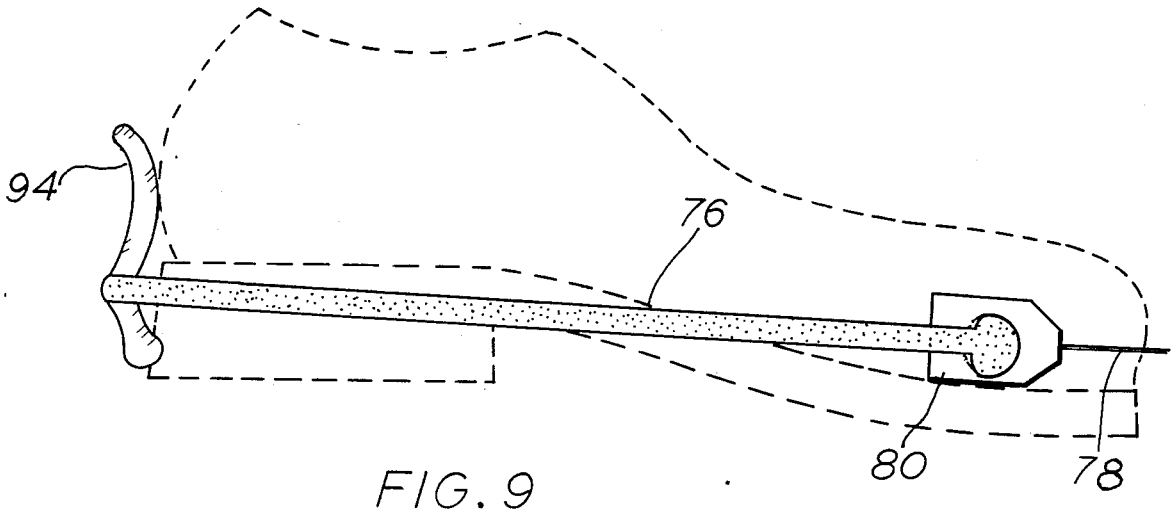
FIG. 9 is a partial view showing the mounting of the heel cable to a ski boot heel according to a preferred embodiment of the present invention, the shoe with heel being shown in phantom.

As shown in FIGS. 1 and 2 an elastic strap 76 is provided to secure the toe plate 52 to a boot of a skier as shown in FIG. 9. This elastic strap is connected to an end of a cable 78 with a connecting device 80. The other end of the cable 78 is connected to a bail 82 as shown in FIG. 1. The bail 82 includes a bell crank pivotally mounted about a pin 84 mounted to the side member 50 of toe plate 52. Cover plates 90 secured to side walls 50 of toe plate 52 and serve to secure the bail 82 on pins 84. Each lateral side of the bail 82 has such a bell crank which pivots about pins 84. A connecting portion 86 as shown in FIG. 2 connects the two bell crank portions of bail 82. This connecting portion 86 extends through slots 88 in side members 50 as shown in FIG. 1. Guides 92 are used to guide the cable 78 from the elastic strap 76 to the bail 82 as shown in FIGS. 1 and 2.

As can be seen, when the elastic strap is drawn to the left as shown in FIG. 1 to engage the heel of the ski boot as shown in FIG. 9, the cable 78 is also drawn in the leftward direction. This causes the bell crank portions of bail 82 to rotate the connecting member 86 in a downward direction.

When a skier desires to insert a boot in this binding the boot is positioned on the toe plate 52. Nordic ski boots conventionally have an extending lip portion of the sole which is conventionally engaged by uprising pins located on conventional cross-country bindings. With the present invention, the bail 82 including connecting portion 86 clamps down on the lip of the forwardly projecting sole of any boot to secure the boot to the toe plate 52.

As shown in FIG. 9 the elastic strap 76 is used to secure the ski boot to the toe plate 52. A throw piece 94 is used for emplacing the elastic strap 76 onto the boot heel and prevents movement of the elastic strap when the ski is being used. The tension in the elastic strap 76 forces the boot into the toe plate 52. Thus the combined action of the bail 82 on the boot toe and the forward thrust of the elastic strap 76 serve to keep the boot firmly in place on the toe plate 52.

It is to be understood that the elastic strap 76 is used only in a preferred embodiment. It is also contemplated that a conventional cable and spring means could also be used as a substitute for the elastic strap.

In order to use this particular invention, the compression force of the coil spring 74 of release button 54 is first adjusted. This is accomplished by pulling the plunger 30 against the bias of spring 32 to disengage the plunger from resting on the top surface of insert 22*a* as shown in FIG. 5. Next the lower end of tubular housing 48 as shown in FIG. 2 is forced upwardly away from the ski. This disengages the lower hemispherical portion 56 as shown in FIG. 2 from the corresponding socket 40. The plunger 30 is then released and the plunger 30 under force of the spring 32 moves to a position on the underside of insert 22*a*. The insert 22*a* then rests on plunger 30. Next the compressive force of the coil spring 74 is adjusted by rotating the hexagonal portion 58 of release button 54 until the desired compression of spring 74 is obtained. Once the compression has been set the tubular housing 48 is forced downwardly. The inserts 22 have a ramp 96 as shown in FIGS. 4 and 5 on the lower side thereof on which surface the plunger 30 is resting. As the tubular housing 48 is forced downwardly the plunger 30 is cammed against the force of spring 32 by ramp 96 as shown in FIG. 5. The plunger 30 rides along the outer surface of insert 22*a* until the plunger 30 reaches the top of insert 22*a*. At this point the plunger 30 moves over the top surface of insert 22*a* to hold the insert 22*a* in place.

Next a skier places his boot on the toe plate 52 and moves the forwardly projecting lip of the sole of the boot under the bail 82. The elastic strap 76 is then grasped with throw piece 94 and extended to engage the rear portion of the heel of the boot and by so doing the connecting portion 86 of the bail 82 moves downwardly to clamp the boot between the bail 82 and the toe plate 52.

The skier is now set to use the cross-country ski in a normal cross-country ski manner. When there is an over stress or twisting of the boot with respect to the ski, the release buttons 54 are forced out of the sockets 40 thereby releasing the release buttons 54, release tube 48, toe plate 52, and cable 76 from the ski.

The post 46 mounted to the mounting member 12 prevents the skier from being released prematurely from the ski when the pressure is applied in the forward direction only. This is desirable as there is a great deal of pressure applied in the forward direction when skiing. On the other hand, if a twisting of the boot occurs, the post 46 acts as a pivot so that one release button releases forwardly and the other release button releases rearwardly.

With the present invention a nordic ski binding is described which is uncomplicated in design and easy to use. The binding enables a nordic skier to ski with safety and also enables the skier to use a boot for a longer period than would otherwise be the case with the uprising pin system which supports the ski boot solely at the toe in the ski binding. Further, the present invention allows the use of many hiking and climbing boots to be used as well as 75 mm cross-country ski boots. The only requirement being that there be a forwardly projecting sole portion of the boot to be engaged by the bail. This makes the present invention much more versatile than the standard three-pin cross-country ski binding.

The toe plate 52 is sized to be only a partial boot plate so that a skier may pivot his boot on the ball of his foot which is necessary in cross-country skiing. Further with the present invention a skier may pivot his entire boot away from the ski, pivoting on the release tube. The extent of this latter pivoting movement may be limited with the stop 77 acting in conjunction with cut-out 75 as explained above.

This particular safety binding is of great value when skiing in rough terrain and when subjected to the type of skiing which is commonly done today.

While the fundamental features of the invention have been shown and described it should be understood that various substitutions and modifications and variations may be made by those skilled in the art without departing from the spirit or scope of the invention. Accordingly, all such modifications and variations are included within the scope of the invention as defined by the following claims.

I claim:

1. An improved ski binding for use with a boot and cross country ski, the boot having a sole which has a portion projecting in the forward direction from the toe of the ski comprising:

a toe plate adapted to be located under and adjacent the forward portion of the ski boot;

a bail means for releasably clamping the forwardly extending portion of the sole of the ski boot to the toe plate;

the bail having a pair of bell crank members each having a first arm and a second arm and each being mounted for rotational movement around a respective pin mounted to the toe plate;

the bell crank members further being connected together with an elongate connecting member, each end of which is secured to a respective first arm of the bell crank members;

the connecting member being adapted to clamp down on the forwardly extending portion of the sole of the ski boot;

an elastic strap having the two ends thereof attached to the respective second arms of each bell crank member and wherein the median of the elastic strap is adapted to be positioned adjacent the heel of the boot;

the bail being positioned so that upon rotation of the bell cranks around their respective pins by movement of the elastic strap to secure the ski boot to the toe plate, the connecting member is rotated downwardly to clamp the forwardly extending portion of the sole of the ski boot between the connecting member and the toe plate;

a pair of open faced sockets which are mounted to the ski and which are disposed along a straight line perpendicular to the longitudinal axis of the ski;

a toe piece secured to the toe plate;

the toe piece having a pair of release buttons, each release button being received by a corresponding one of the open faced sockets; and means for resiliently urging the release buttons into their corresponding sockets whereby the toe piece and thus the ski boot is releasably held by the sockets to the ski.

2. The improved ski binding according to claim 1 wherein the means for resiliently urging the release buttons into the sockets comprises a coil spring.

3. The improved ski binding according to claim 2 further including means for adjusting the spring compression force of the coil spring urging the release buttons into the sockets.

4. The improved ski binding according to claim 3 wherein the means for adjusting the spring compression force includes means connected to a release button whereby the spring compression force is adjusted by rotating the release button.

5. The improved ski binding according to claim 4 further including means for selectively preventing rotation of the release buttons once the compression force is adjusted.

6. The improved ski binding according to claim 5 wherein the means connected to the release button includes a multisided portion and further wherein at least one of the opposed open faced sockets has a portion shaped to receive at least two sides of the multisided portion to prevent rotation of the release button when the spring tension has been set.

7. The improved ski binding according to claim 1 further including a post connected to the ski to prevent release of the, toe piece from the sockets when forces acting on the toe piece are in a solely forward direction.

8. The improved ski binding according to claim 1 wherein the release buttons and sockets are correspondingly shaped to permit rotational movement of the toe piece about an axis extending between the two sockets.

9. The improved ski binding according to claim 8 wherein limit means are provided for limiting the rotational movement of the toe piece about the axis extending between the two sockets.

* * * * *